US010510326B1

(12) United States Patent
Wada

(10) Patent No.: US 10,510,326 B1
(45) Date of Patent: Dec. 17, 2019

(54) BOW GRIP AID FOR STRING INSTRUMENTS

(71) Applicant: Rintaro Wada, Allegany, NY (US)

(72) Inventor: Rintaro Wada, Allegany, NY (US)

(73) Assignee: Ritsuko Wada, Allegany, NY (US)

( * ) Notice: Subject to any disclaimer, the term of this patent is extended or adjusted under 35 U.S.C. 154(b) by 0 days.

(21) Appl. No.: 16/282,312

(22) Filed: Feb. 22, 2019

(51) Int. Cl.
*G10D 3/16* (2006.01)

(52) U.S. Cl.
CPC ..... *G10D 3/16* (2013.01)

(58) Field of Classification Search
CPC ..... G10D 3/16
See application file for complete search history.

(56) References Cited

U.S. PATENT DOCUMENTS 1,897,225 A * 2/1933 Archer ..... G10D 3/16 84/282
7,595,441 B1 * 9/2009 Dubell-Shockley ... G09B 15/00 84/282
D650,830 S 12/2011 Kimmons et al.
8,273,973 B2 9/2012 Kimmons et al.

OTHER PUBLICATIONS

Stringvision Bowgrip, [Searched on Apr. 25, 2019], Internet <URL: https://stringvision.myshopify.com/products/stringvision-bowgrip>.
Things 4 Strings, [Searched on Apr. 25, 2019], Internet <URL: https://www.things4strings.com/shop/category/34-for-cello-and-french-bass>.

* cited by examiner

*Primary Examiner* — Kimberly R Lockett
(74) *Attorney, Agent, or Firm* — Yokoi & Co., U.S.A.; Toshiyuki Yokoi

(57) ABSTRACT

A bow grip aid for string instruments comprised of a body having a U-shape in cross-section so as to be capable of sandwiching a stick of a bow, wherein the body includes a first portion and a second portion to sandwich the stick by the first portion and the second portion from both sides, a surface of the first portion has a recess corresponding to a thumb of a player on the opposite side of a surface contacting with the stick, a distance from a bottom of the recess of the first portion to a surface of the stick is 2 mm to 10 mm, a length of the second portion in a longitudinal direction of the stick is 30 mm to 50 mm, and a thickness of the second portion from a surface contacting with the stick to an opposite surface is 5 mm to 15 mm.

7 Claims, 12 Drawing Sheets

BOW GRIP AID FOR STRING INSTRUMENTS

BACKGROUND OF THE INVENTION

1. Field of the Invention

The present invention relates to a bow grip aid for string instruments, especially relates to a bow grip aid suitable for a cello bow and a contrabass bow (French style).

2. Description of Related Art

A human hand has a shape suitable for grasping a spherical body. For example, when a player faces their palm upward and relaxes their fingers, a recess suitable for placing a ball is formed on the palm. In the above described state, the human can grasp the ball tightly.

If the ball is replaced with the cello bow or the contrabass bow, the stick is held by the thumb and four fingers aligned from the index finger to the pinky along the linearly formed stick. However, it is unnatural to align four fingers from the index finger to the pinky along a linearly formed stick.

Furthermore, the thumb is preferably positioned to hold the stick with the middle finger and the ring finger. At that time, the nail of the thumb faces toward the stick. For a beginner who starts to practice the playing, it is difficult to maintain the hand form of holding the stick with the thumb, the middle finger and the ring finger, maintain a balance with the index finger and the pinky, while continuing to play in a state in which a bow is perpendicular to the string of the cello or the contrabass.

On the other hand, bow grip aids for the beginners who practice playing the cello or the contrabass shown in Non-patent document 1 and Non-patent document 2 are known.

The bow grip aid shown in Non-patent document 1 is a tubular member that entirely covers where the stick and frog of the bow are connected. It is a cover formed along an outer shape of the connected portion of the stick and the frog. The thickness of the cover as a whole is nearly constant. A recess is formed on the head side of the frog at a portion between the bow hair and stick. When the player puts their thumb in the recess, the position of the thumb is prevented from being displaced.

The bow grip aid shown in Non-patent document 2 is in similar to Non-patent document 1 in that a connection portion between the stick and the frog of the bow is entirely covered. However, the bow grip aid of Non-patent document 2 has the entire form of an elephant as a motif and is thicker than that of Non-patent document 1. Also similar to the bow grip aid of Non-patent document 1, a circular hole formed by a trunk of the elephant is created to form a circle on the head side of the frog at a portion between the bow hair and the stick. When the player puts their thumb in the circular hole, the position of the thumb is prevented from being displaced.

In the bow grip aid shown in Non-patent document 1, the bow grip aid is held with all fingers from the index finger to the pinky of the player. In the bow grip aid shown in Non-patent document 2, although the index finger is positioned on the stick, the fingers from the middle finger to the pinky finger are placed on the bow grip aid.

Non-Patent Document 1 https://stringvision.myshopify.com/products/stringvision-bowgrip

Non-Patent Document 2 https://www.things4strings.com/shop/category/34-for-cello-and-french-bass

BRIEF SUMMARY OF THE INVENTION

In the bow grip aid shown in Non-patent document 1, four fingers from the index finger to the pinky should be aligned linearly along the stick. The problem of the unnatural posture cannot be solved.

In the bow grip aid shown in Non-patent document 2, the thumb is wrapped around a portion between the index and middle fingers. The fingers are aligned along the trunk to the back of the elephant. At that time, the whole hand is naturally inclined toward the tip side of the bow. This is suitable for placing the tip portion of the bow on the string, but not suitable for placing the frog side of the bow on the string. When the frog side of the bow is placed on the string, the whole hand should be freely inclined toward the frog side of the bow. However, the fingers are aligned along the roundness of the back of the elephant and thus the whole hand is fixed to be inclined toward the tip side of the bow. Thus, the problem of the unnatural posture cannot be solved when the frog side is placed on the string.

In the bow grip aid shown in Non-patent document 1, although the position of the thumb is fixed, the positions of the rest of the fingers are not limited with respect to the position of the thumb. In principle, the thumb should be placed at a portion approximately between the middle finger and the ring finger. However, since the fingers can be laterally slid without restriction, the problem of the difficulty cannot be solved when the bow is held in a correct manner.

In the bow grip aid shown in Non-patent document 2, although the forefinger is in contact with the stick, the balance is always inclined toward the tip side of the bow. Thus, the adjustment of the change of the gravity center position cannot be practiced.

The present invention solves the above described conventional problems.

Means for Solving the Problem

The present invention is a bow grip aid for string instruments, the bow grip aid has: a body having a U-shape in cross-section so as to be capable of sandwiching a stick of a bow, wherein the body includes a first portion and a second portion to sandwich the stick with the first portion and the second portion from both sides, a first surface of the first portion has a recess corresponding to a thumb of a player, the first surface being on the opposite side of a second surface contacting with the stick, a distance from a bottom of the recess of the first portion to a surface of the stick is 2 mm to 10 mm, a length of the second portion in a longitudinal direction of the stick is 30 mm to 50 mm, and a thickness of the second portion from a third surface contacting with the stick to a fourth surface is 5 mm to 15 mm, the fourth surface being on the opposite side of the third surface.

In the bow grip aid of the present invention configured as above, since the body has a U-shape in cross-section, the thumb grip of the stick of the bow can be sandwiched by the first portion and the second portion. In addition, since the first surface of the first portion of the body has a recess on the opposite side of the second surface contacting with the stick, the position of the thumb is stabilized by placing the tip of the thumb of the player on the recess. As later explained, since the middle finger and the ring finger are positioned on the second portion which is opposite to the first portion, the thumb is naturally held on a position between the middle finger and the ring finger.

Additionally, the length of the second portion in a longitudinal direction of the stick is 30 mm to 50 mm. The above described length is an average length of the total width of the middle and ring fingers of the human body of the player. It is approximately equal to the average distance between the index finger and pinky. Accordingly, the player can keep the hand form of placing the middle and ring fingers on the second portion. Since the length is specified to be fit between the length of the space between index and pinky fingers, the index and pinky fingers are not placed on the first portion, instead, they are directly in contact with the stick.

Since the thickness of the second portion from the third surface contacting with the stick to the fourth surface opposite to the third surface is 5 mm to 15 mm, when the middle and ring fingers of the human body of the player are placed on the third surface and the index finger and pinky are placed on the stick, the player feels a roundness as if the player holds a ball. Thus, a natural curve is drawn from the index to the pinky finger.

Furthermore, the distance from the bottom of the recess of the first portion to the surface of the stick is 2 mm to 10 mm. When the tip of the thumb is inserted into the recess, the distance from the tip of the thumb to the back of the middle or ring finger is approximately 7 mm to 25 mm longer than the diameter of the stick. Thus, the distance is suitable for the beginner to hold the bow easily.

Effects of the Invention

By attaching the present invention to the thumb grip of the bow, the player can place the tip of the thumb between the middle and ring fingers to sandwich/hold the thumb grip or neighboring portion by the tip of the thumb, the middle finger and the ring finger. At that time, a natural curve is drawn from the index to the pinky finger. Thus, even the beginner can hold the bow stably and practice the bowing correctly.

DETAILED DESCRIPTION OF THE INVENTION

Hereafter, the embodiments of the present invention will be explained based on the drawings.

Figure 1:
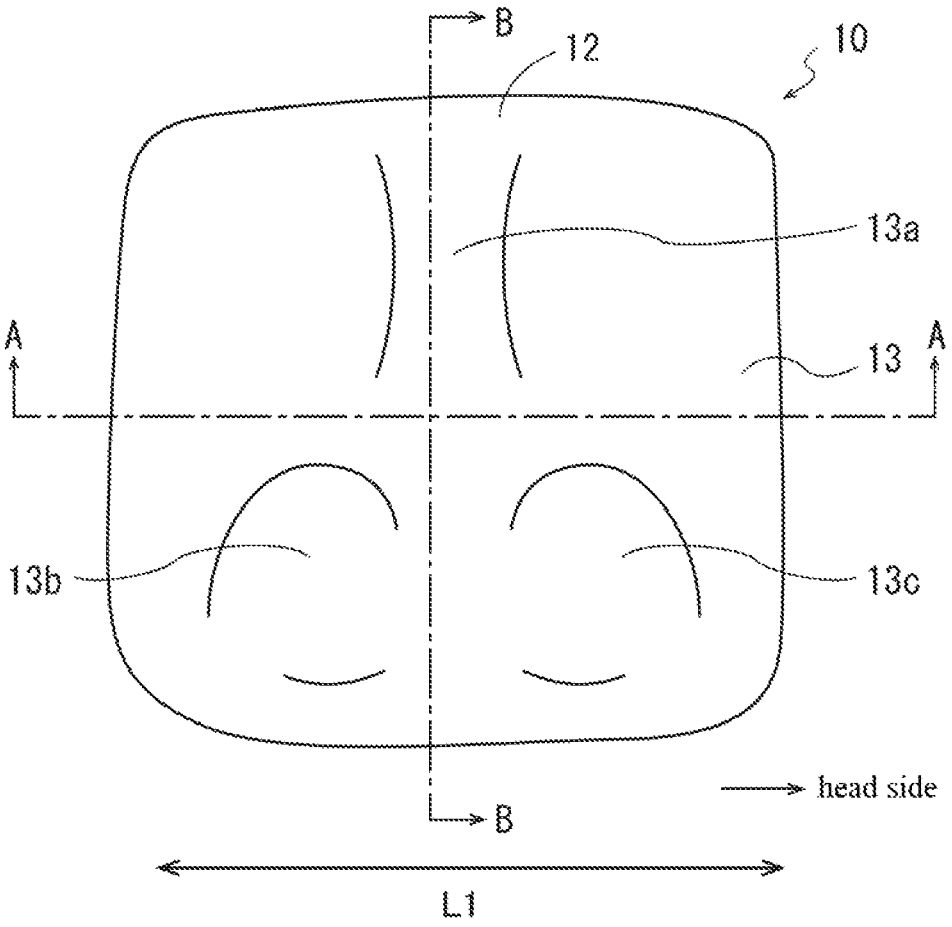
FIG. 1 is a plan view of a bow grip aid.
Figure 2:
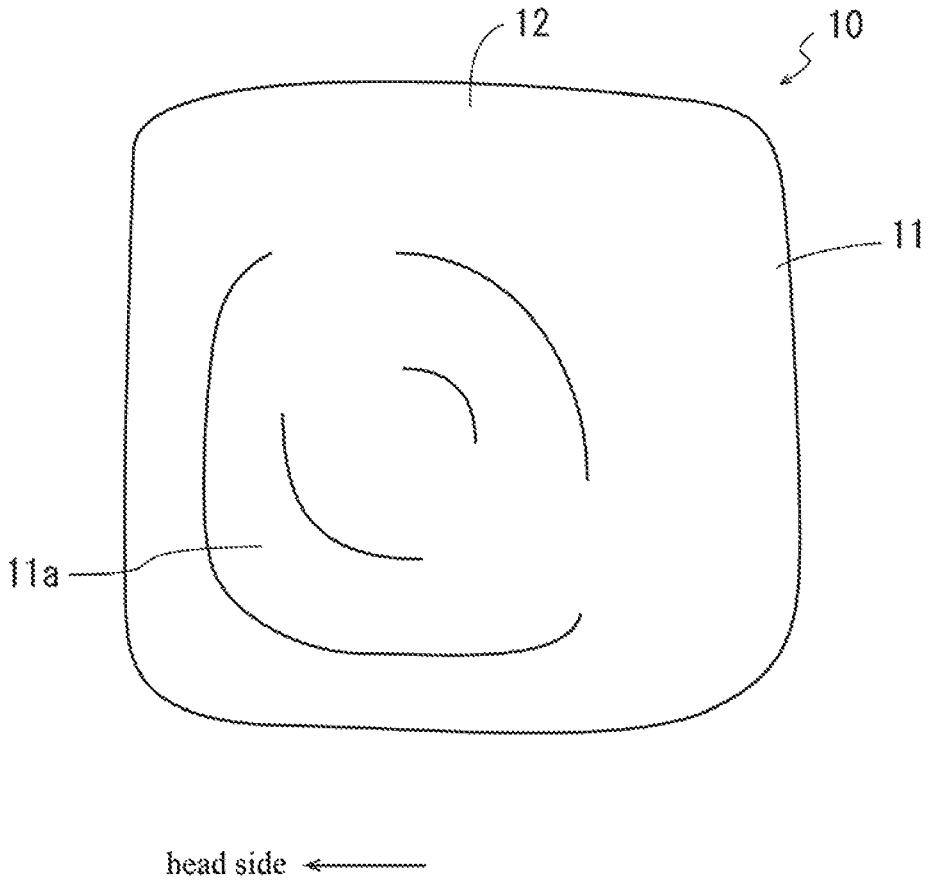
FIG. 2 is a bottom view of the bow grip aid.
Figure 3:
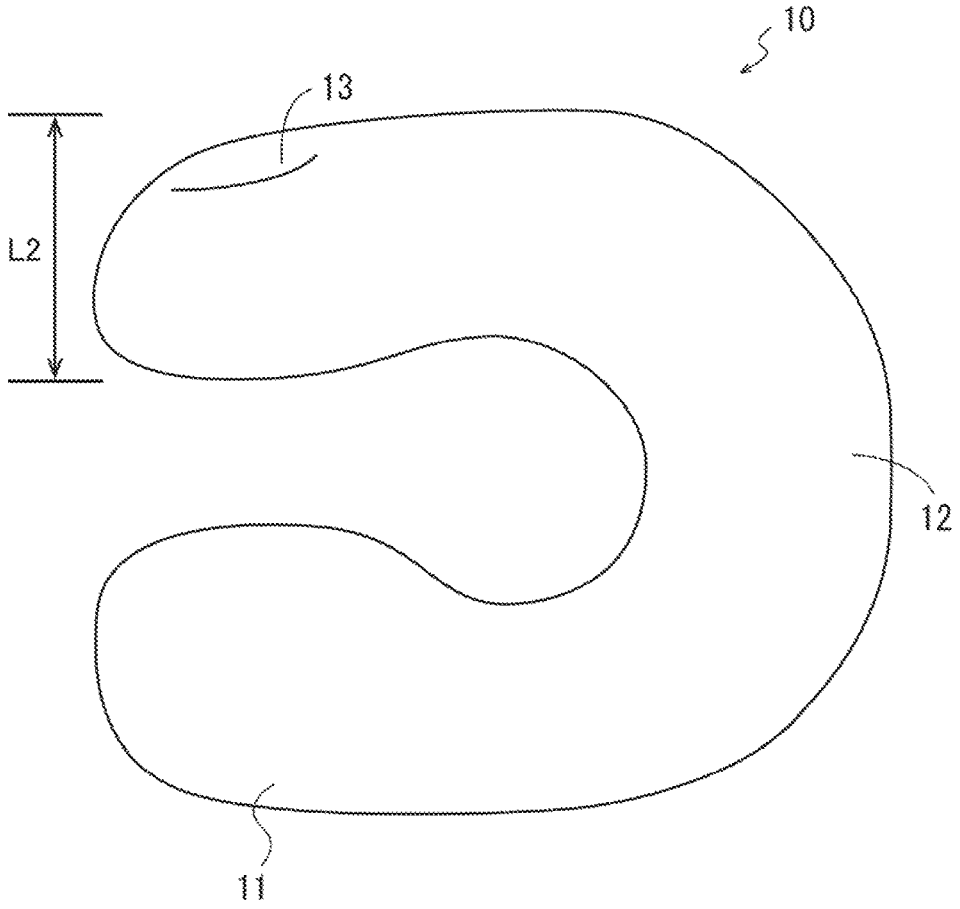
FIG. 3 is a side view of the bow grip aid.
Figure 4:
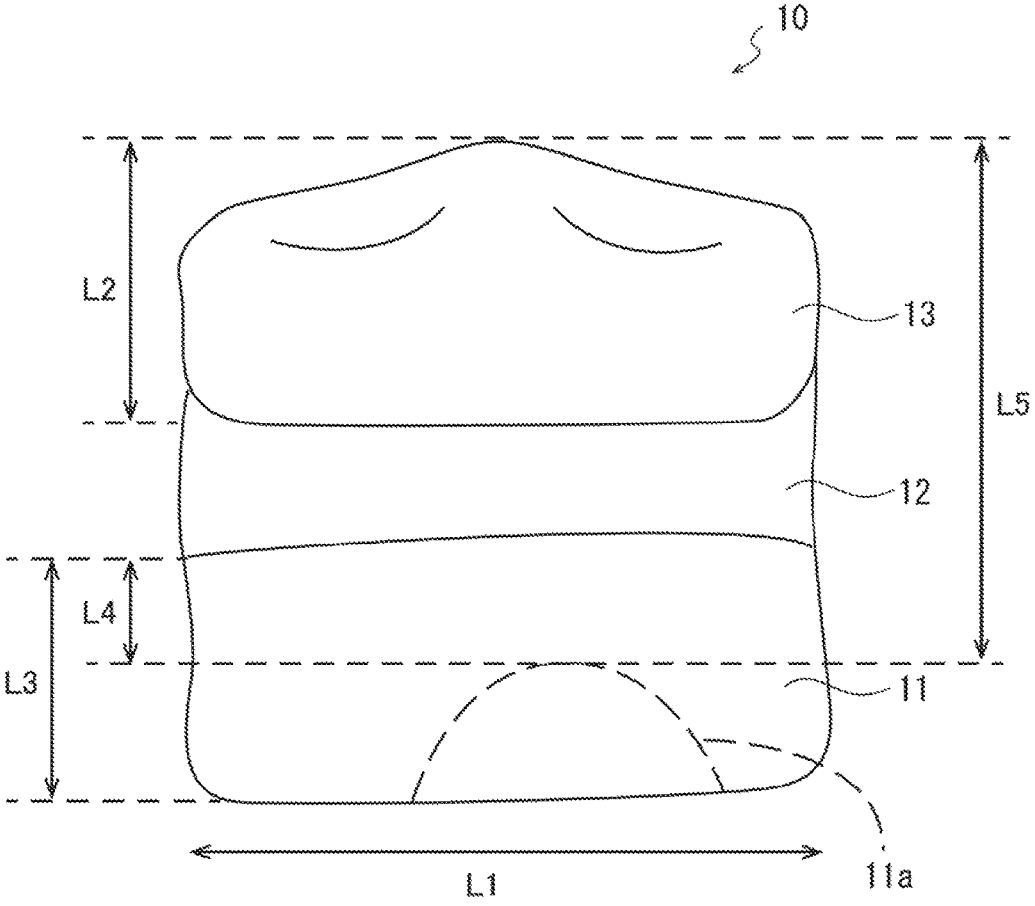
FIG. 4 is a front view of the bow grip aid.

FIG. 1 shows a bow grip aid in a plan view, FIG. 2 shows it in a bottom view, FIG. 3 shows it in a side view, and FIG. 4 shows it in a front view.

Figure 5:
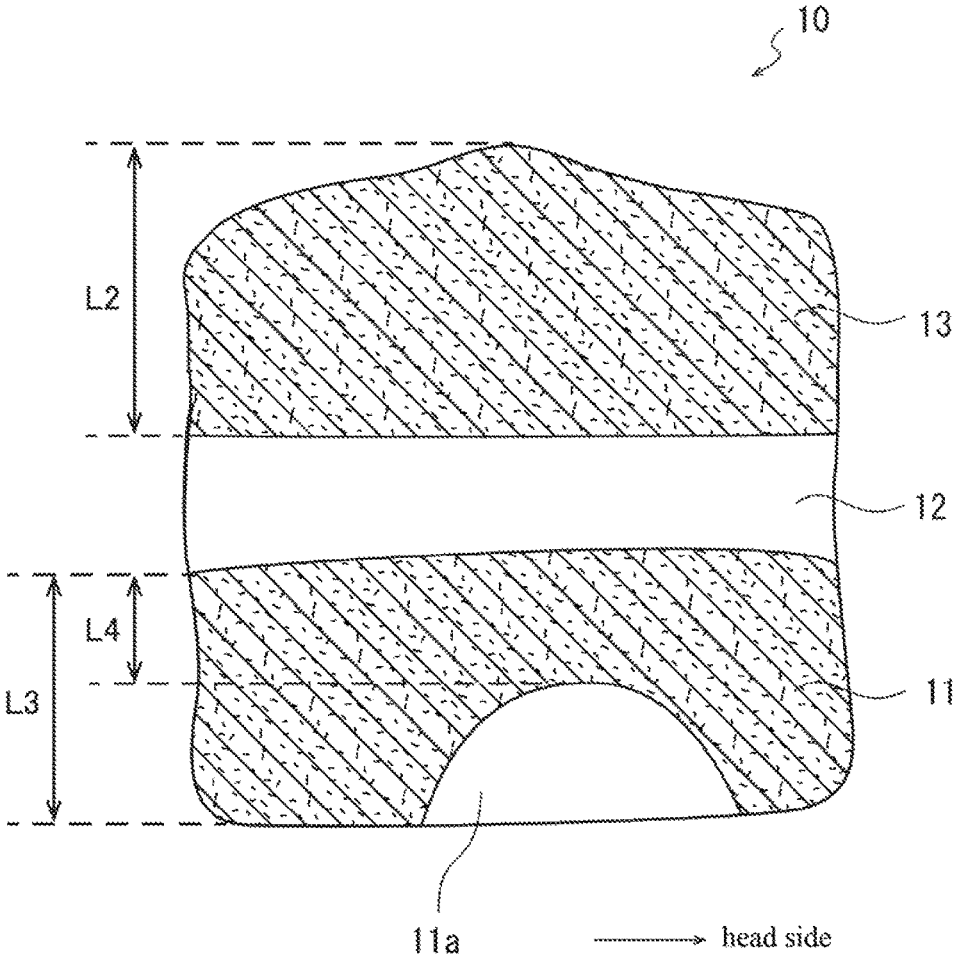
FIG. 5 is a cross-sectional view of the bow grip aid taken along the A-A line in FIG. 1.
Figure 6:
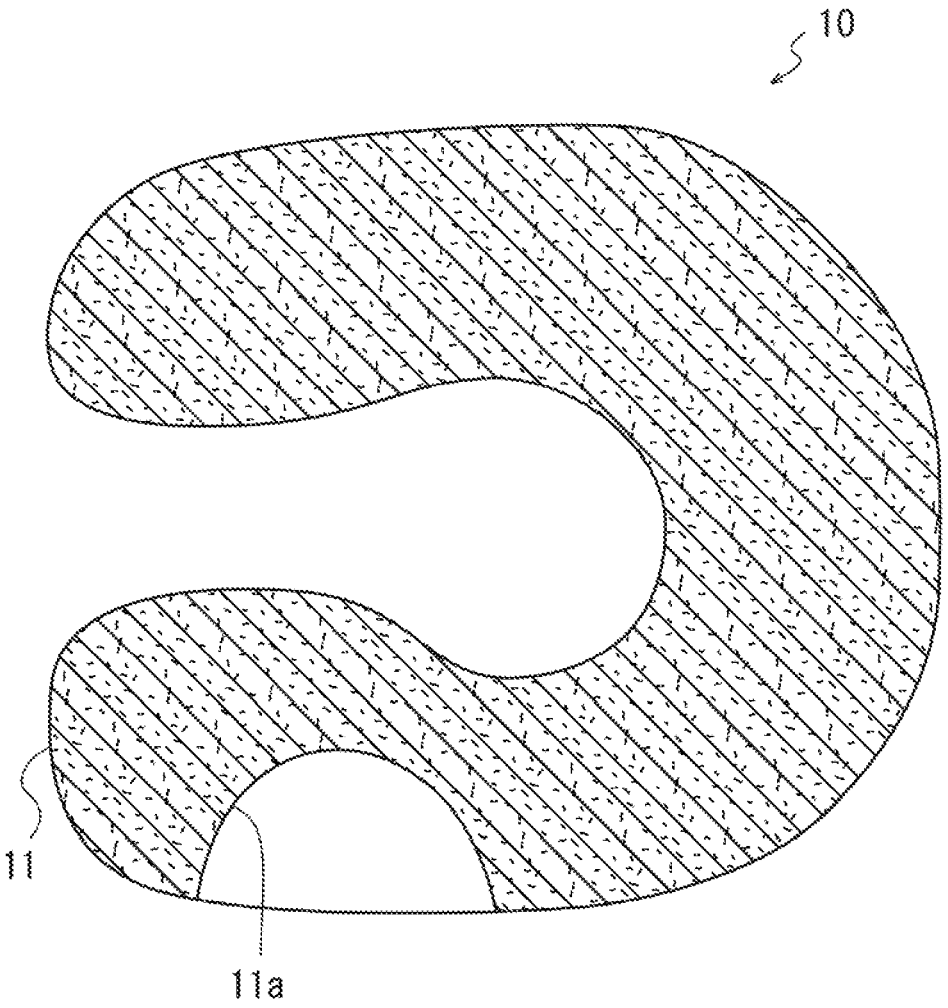
FIG. 6 is a cross-sectional view of the bow grip aid taken along the B-B line in FIG. 1.
Figure 7:
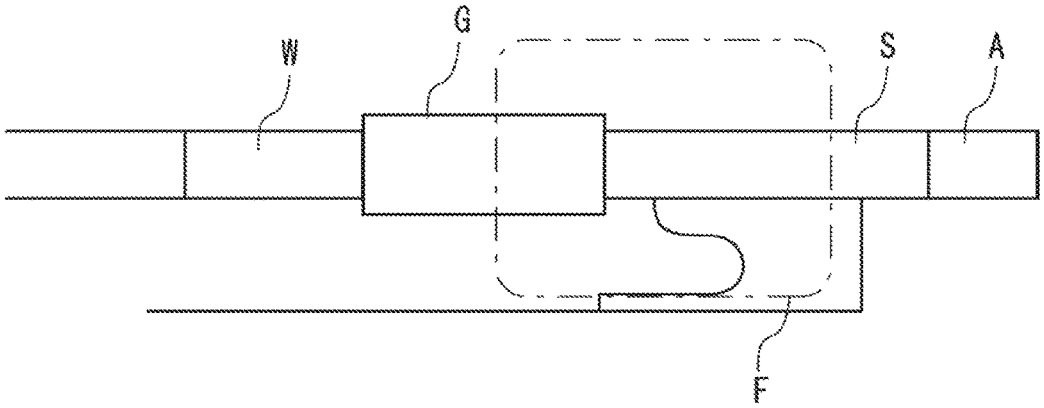
FIG. 7 is a plan view showing a part of a bow to which the bow grip aid is attached.

In addition, FIG. 5 shows the bow grip aid in a cross-sectional view taken along the A-A line of FIG. 1, FIG. 6 shows it in a cross-sectional view taken along the B-B line of FIG. 1, and FIG. 7 shows a part of a bow to which the bow grip aid is attached in a plan view.

As shown in FIG. 3, the bow grip aid is formed by a body 10 having a U-shape in cross-section when viewed from a lateral side. The body 10 includes a first portion 11, a connection portion 12 and a second portion 13. The first portion 11, the connection portion 12 and the second portion 13 are connected with each other to have a U-shape as a whole. It can also be said that the body 10 has a saddle shape as a whole.

In a stick S of a cello bow or a contrabass bow (hereafter referred to merely as a bow) of the string instruments, a tip end is called as a head and a rear end is called as an adjuster A. Since the body 10 has a U-shape, the body can be attached to the stick S by sandwiching the stick S with the first portion 11 and the second portion 13. Inner surfaces of the first portion 11, the second portion 13 and the connection portion 12 have a substantially cylindrical inner peripheral surface to be easily attached to the stick S having a cylindrical shape. As explained above, the body 10 includes the connection portion 12 connecting the first portion 11 with the second portion 13. The connection portion 12 has a cylindrical inner peripheral surface to be capable of being in contact with the stick S.

Recesses can be appropriately formed on the inner surfaces of the first portion 11 and the second portion 13 according to the shape of the frog, the position of the string and the size of the thumb grip to prevent the body 10 from moving when the body 10 is attached to the stick S by sandwiching the stick S with the first portion 11 and the second portion 13.

The body 10 is attached to a portion surrounded by a dot and dash line shown in FIG. 7.

The body 10 is attached to a position ranging from a portion where a frog F is in contact with the stick S to a thumb grip G A wrapping W is formed on the stick S at the head side of the thumb grip G.

Since the first portion 11, the second portion 13 and the connection portion 12 are integrally formed, these portions cannot be clearly separated from each other. It can be said that the stick S is held by the first portion 11 and the second portion 13 since the stick S is sandwiched by the first portion 11 and the second portion 13. It also can be said that the stick S is held by the first portion 11, the second portion 13 and the connection portion 12. In either case, since playing is made in a state that the body 10 is attached to the stick S, the body 10 is integrated with the stick S not to be displaced and rattled. Note that the body 10 is made of an elastic material as a whole. Since the body 10 has elasticity, an interval between the first portion 11 and second portion 13 can be extended by bending the first portion 11 and second portion 13. Thus, the rod-shaped stick S can be fitted inside the first portion 11 and the second portion 13. Note that it is not necessary to integrally form the first portion 11, the second portion 13 and the connection portion 12. They can be formed separately.

When considering the state in which the body 10 is attached to the stick S, the body 10 has a predetermined length L1 in a direction of the stick S. While playing, the player's thumb is in contact with the first portion 11, and their middle and ring fingers are placed on the second portion 13. The thumb is placed on the opposite side of the middle and the ring fingers at a position between the middle and ring fingers to sandwich and hold the stick S. Accordingly, the thumb should not be placed at the head side of the middle finger nor the adjuster A side of the ring finger.

Therefore, the second portion for placing the middle finger and the ring finger has a length suitable for placing two fingers on it. It is not large enough to place three fingers on it and not small enough to place only one finger on it. In the present embodiment, the length L1 of the body 10 is within the range of 30 mm to 50 mm. As long as the length L1 is in the above described range, the body 10 can be small enough for kids and large enough for adults. As long as the size is in the above described range, the length L1 can be arbitrarily changed according to the purpose of use.

Only the middle finger and the ring finger are placed on the second portion 13, and the index and pinky fingers are not placed on the second portion 13. Therefore, there is no need to linearly align four fingers from the index finger to the pinky along the stick S. In addition, since the outside is made lower than the middle portion, the second portion 13 fits well as if a ball was placed on the palm. Namely, a projection having a low chevron shape is currently formed. Thus, the middle and ring fingers are naturally separated from each other in an optimal manner when holding the bow.

The length L1 can be within a range of 30 mm to 35 mm as a preferable example. If the length L1 is smaller than the above described range, it is difficult to place two fingers (middle finger and ring finger) on it. If it is difficult to place the two fingers (middle finger and ring finger), the bow will mainly be supported by one of the two fingers spontaneously. However, as described later, the above described state causes unbalance when keeping the balance with the index and pinky fingers during the bowing. In many cases, when the length L1 is 30 mm to 35 mm, the middle and ring fingers can be placed while slightly forming a space between them. Since the second portion 13 is projected in a chevron shape, the space can easily be formed between the middle and ring fingers. Furthermore, the index and pinky fingers can be in contact with the stick S by naturally by sandwiching the second portion 13.

The length L1 can be within a range of 35 mm to 40 mm as a preferable example. In the above described case, since a larger space can be formed between the middle and ring fingers, the stick S can be more stably held when the stick S is held at three points of the middle finger, ring finger and the thumb. Additionally, the index finger and pinky finger can be in contact with the stick S by sandwiching the second portion 13 without difficulty.

The length L1 can be within a range of 40 mm to 50 mm as a preferable example. Since the thickness of the finger is uniquely dependent on the player, the above described range may be suitable for a person having thick fingers. In addition to this, since the space between the index and pinky fingers is expanded within a reasonable range, the index and pinky fingers are in contact with the stick S in a long range. Thus, the stick S can be held stably.

As previously explained, since the space is specified so that only the middle finger and the ring finger can be placed, the gravity center is located approximately at a center, between the index and pinky fingers. In the conventional one, since the gravity center is not located at the center and is shifted to one side, it is not suitable for practicing the bowing.

The second portion 13 is not only for increasing grip like a ball but also for increasing balance during the bowing.

In the surface of the second portion 13 in which the middle and ring fingers are placed, a portion 13*a* has a slight chevron shape at a section near the connection portion 12 so as to be projected most at an intermediate portion and less projected towards the front-rear direction of the stick S. Since the intermediate portion is projected the most, when the middle finger and the ring finger are placed, the body 10 is sandwiched from the front and the rear. Thus, the fingers are prevented from releasing from the body 10. On the other hand, in the surface of the second portion 13, shallow recesses 13*b*, 13*c* are formed at a portion far from the connection portion 12. Because of this, the pads of the middle and ring fingers slightly enter in the recesses 13*b*, 13*c*. Thus, the fingers are prevented from displacing.

In the present embodiment, the end portion of the first portion 11 and the end portion of the second portion 13 are separated from each other at the opposite side of the connection portion 12. However, the end portions of the first portion 11 and the second portion 13 can be formed to project towards each other at the opposite side of the connection portion 12 to be approximately in contact with each other. In the above described case, the bow is almost surrounded by the first portion 11 located at the upper part, the second portion located at the lower part and the connection portion 12. Consequently, the bow can be prevented from slipping off.

FIG. 8 to FIG. 11 show modified examples of the bow grip aid.

Figure 8:
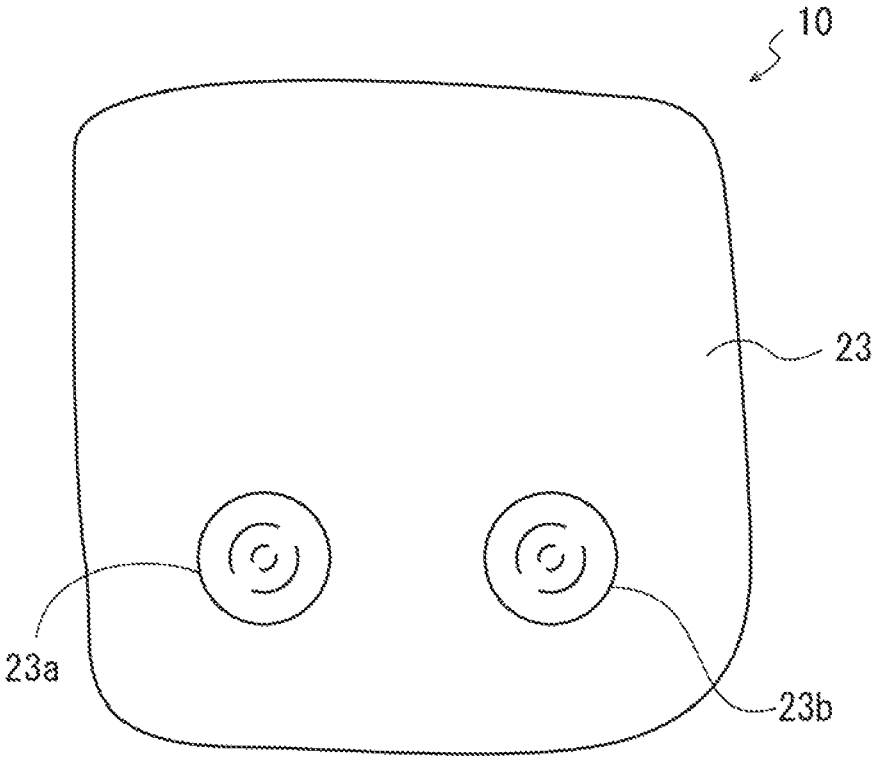
FIG. 8 is a drawing showing a modified example of the bow grip aid.

FIG. 8 is a modified example where portions to be in contact with the ball side of the middle and ring fingers are recessed.

On the upper surface of the second portion 23 of the body 20, recesses 23*a*, 23*b* having a conical shape are formed at the portions to be in contact with the pad side of the middle and ring fingers. The conical shape can have a shallow slope. For example, an apex angle can be approximately 160°. Of course, the outer shape of the recesses 23*a*, 23*b* are not necessarily an annular shape. The outer shape can be a square shape or a polygonal shape. The cross-sectional shape of the recesses 23*a*, 23*b* can be a spherical shape. As explained above, two recesses 23*a*, 23*b* are formed on the second portion 23 along the longitudinal direction of the stick S when attached to the stick S.

Figure 9:
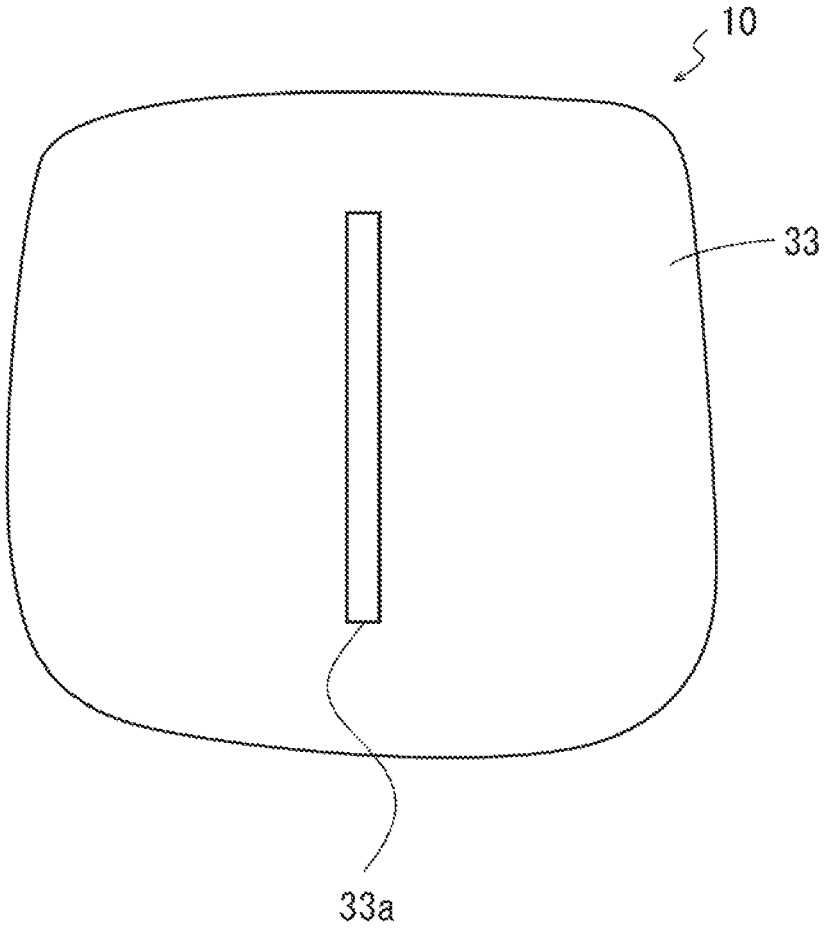
FIG. 9 is a drawing showing a modified example of the bow grip aid.

FIG. 9 is a modified example where a partition wall is formed to separate the place on which the middle finger and the ring finger are placed in the front-rear direction.

Namely, this is an example of increasing the height of the chevron shape of the chevron shape for separating the middle finger from the ring finger.

On an upper surface of a second portion 33 of a body 30, a projection 33*a* is formed approximately at a center in the longitudinal direction of the stick S to divide the upper surface of the second portion 33 in the front-rear direction. The height of the projection 33*a* can be low. For example, the height can be approximately 2 mm.

As explained above, the second portion 33 has the projection 33*a* formed at the center of the second portion 33 to divide the second portion 33 into two along the longitudinal direction of the stick S when the bow grip aid is attached to the stick S.

As one of the essential requirements for creating a sound correctly, the bow and the string should be always orthogonal to each other. However, in many cases, the tip side of the bow is lowered, the thumb enters between the hair and wooden part of the bow, and the right hand strongly grasps the bow without helping to balance the bow on the string. Thus, the bowing is enabled only around the center within the range of approximately 10 cm to 15 cm from the balance point of the bow.

When the bow is placed on the string, the weight varies between the tip side of the bow and the frog side of the bow, namely the right and left relative to the balance point on the string. At the balance point, the right hand holding the bow uniformly uses three points of a large triangle formed by the thumb, index finger and pinky finger. The contact point of the string and the bow is gradually converged to one point toward the tip side of the bow, and the balance should be kept with three points: the one point; the thumb; and index finger. Additionally, the contact point of the string and the bow is gradually converted to one point in the opposite direction toward the frog side of the bow, and the balance should be kept with three points: the one point; the thumb; and the pinky finger.

As explained above, it is important in the bowing that the sense of keeping the balance using the index finger and pinky finger accordingly to the playing state. In the present invention, the index and pinky finger directly touches the stick S without placing the index and pinky finger on the body 10. Accordingly, the fingers can be correctly placed on the bow by using the bow grip aid. Thus, it is easy to understand "the balance of the hand holding the bow" correctly.

As shown in FIG. 2, FIG. 5 and FIG. 6, the surface of the first portion 11 has a recess 11*a* corresponding to the thumb of the player on the opposite side of the surface contacting with the stick S. The shape of the recess 11*a* is formed so that thumb is bent from the head side toward the adjuster side and inserted into the recess 11*a* from the nail side of the thumb when attached to the bow. The nail tip side of the thumb abuts on the deepest part of the recess 11*a*. Namely, the recess 11*a* of the first portion 11 has a cone shape gradually deepening toward the deepest part when the bow grip aid is attached to the stick S. Consequently, the nail of the thumb of the right hand is stuck in the approximately deepest part of the right side of the recess 11*a*, and the surface of the nail of the thumb is in parallel with the bow. Thus, an ideal form can be achieved. Note that the inner surface part located at the reverse side of the recess 11*a* for the thumb has a projected shape along the recess 11*a* for the thumb.

Figure 10:
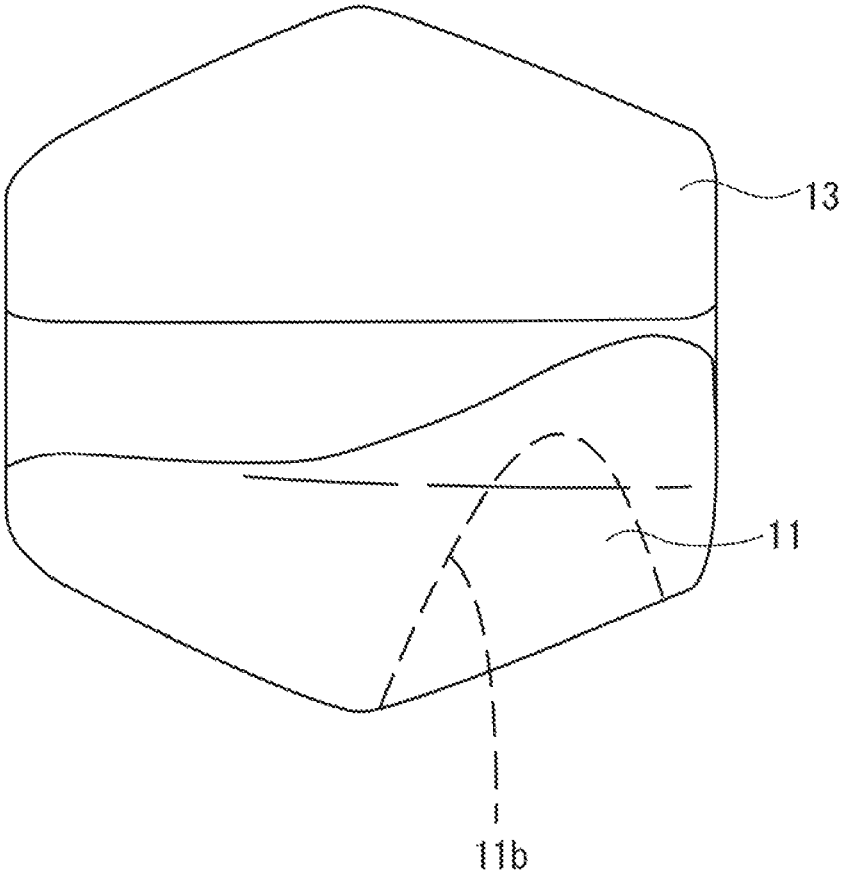
FIG. 10 is a drawing showing a modified example of the bow grip aid.
Figure 11:
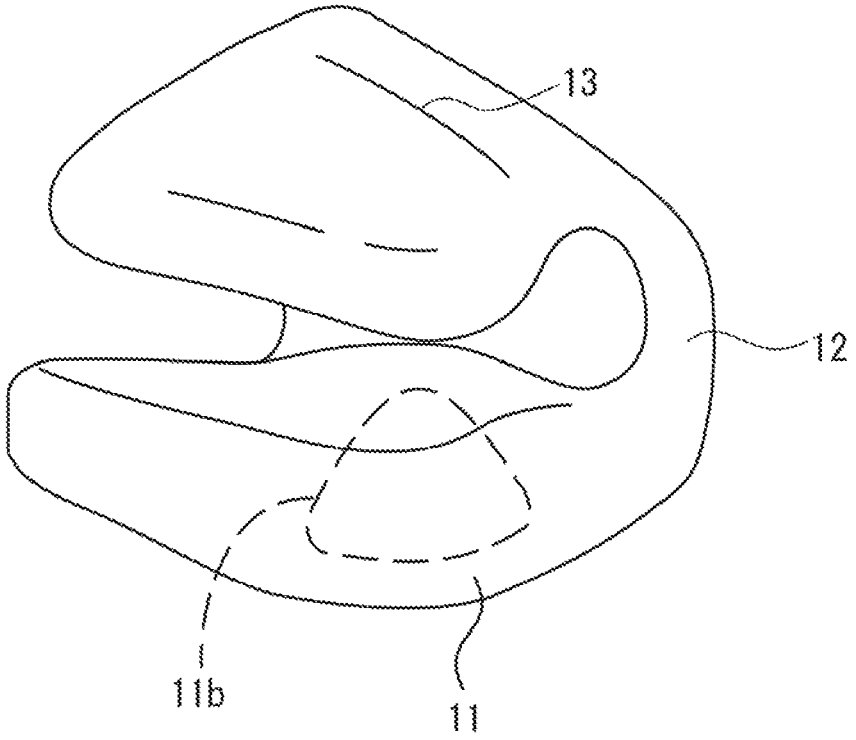
FIG. 11 is a drawing showing a modified example of the bow grip aid.

FIG. 10 and FIG. 11 show the example where the first portion is modified.

FIG. 10 shows the state viewed from the front, and FIG. 11 is shown as a perspective view.

As shown in the figures, the inner side of a recess 11*b* of the thumb is more projected in the first portion 11. Since the first portion 11 is projected toward the inner side, the bow is almost covered in a state that the first portion 11 faces the second portion 13.

Consequently, the bow can be more safely prevented from slipping off.

Figure 12:
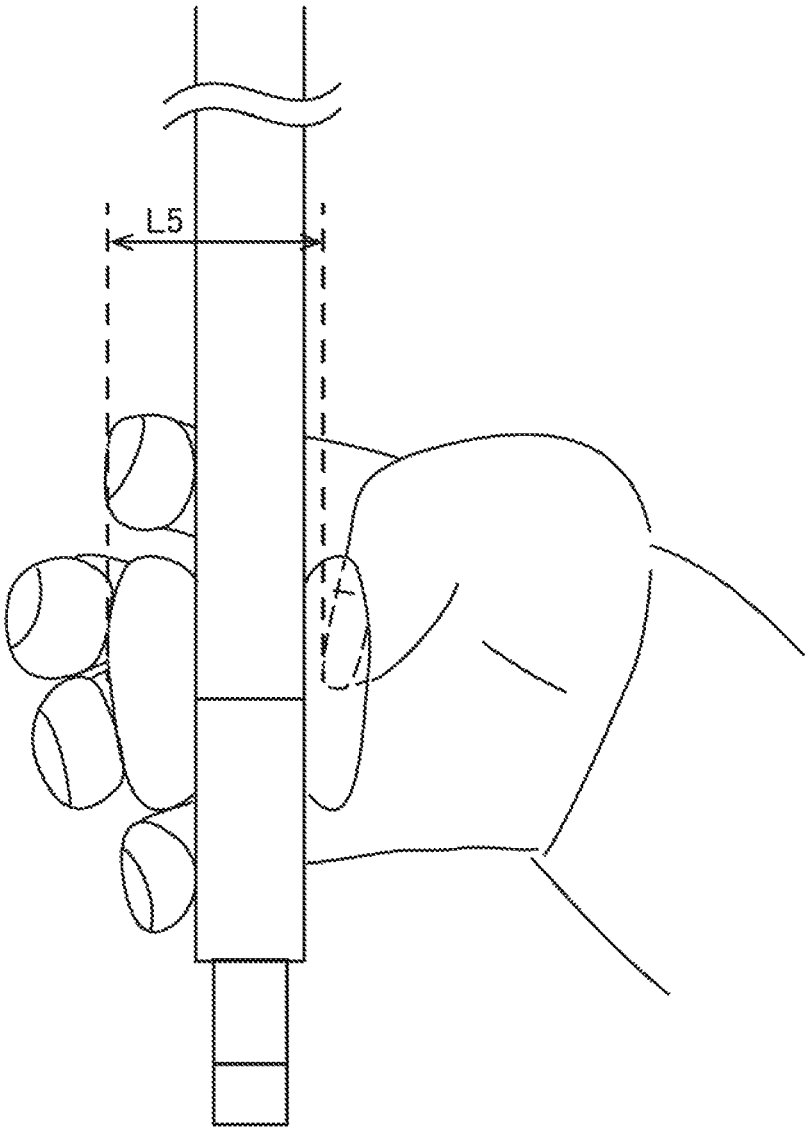
FIG. 12 is a drawing showing a state in which the bow is equipped with the bow grip aid and is held by the hand and viewed from the front side.

FIG. 12 shows a state in which the bow equipped with the bow grip aid is held by the hand and viewed from the front side.

A thickness L2 of the second portion 13 is approximately 10 mm although the surface has a slight chevron shape. On the other hand, the substantial thickness of the first portion 11 corresponds to a depth L4 from the deepest part of the recess 11*a* to the stick S. The substantial thickness is approximately 3 mm to 5 mm. Consequently, when the stick S is approximately 10 mm, a distance L5 from the tip of the nail of the thumb to the pad of the middle finger or the ring finger is approximately 23 mm to 25 mm. As an example, L5 of the bow grip aid made for the cello is 25 mm and L5 of the bow grip aid made for the contrabass is 30 mm.

If the bow grip aid is not used, the beginner should hold the stick S having the thickness of approximately 10 mm. Actually, however, it is difficult to hold the thickness of approximately 10 mm by the thumb, the middle finger and the ring finger. On the other hand, if the thickness of the object to be held is set to approximately 25 mm, the difficulty for holding the bow can be reduced for the beginner.

The thickness L2 of the second portion 13 is preferably in the range of 5 mm to 15 mm, which includes approximately 10 mm. Additionally, a length L4 from the deepest part of the recess 11*a* of the first portion 11 to the surface of the stick S is preferably in the range of 2 mm to 10 mm, which includes 3 mm to 5 mm of the present embodiment. A thickness L3 of the first portion 11 is preferably in the range of 10 mm to 15 mm considering 2 mm to 10 mm of the length L4.

The basis of the bowing is "movement." For generating sounds, the bow should be constantly reciprocated laterally on the strings. In order to do that, it is required that the hand holding the bow is always relaxed.

It is difficult to relax the right hand while coordinating with musical interval, fingering and rhythm which are adjusted by the left hand. When the right hand holding the bow becomes stiff, the right forearm, upper arm, shoulder, back and other parts of the body become stiff. Finally, the movement of the left hand is affected. When the hand is assisted by the device of the present invention, the hand holding the bow is prevented from becoming stiff. Thus, the hand can easily be relaxed. Consequently, adverse effects affecting from the right hand to the left hand can be prevented and progress can be urged.

It is difficult for the beginner to relax the hand when holding the stick S of an approximately 10 mm. However, as explained above, it is relatively easy to hold the stick S of approximately 20 to 25 mm. When the stick S is easily held, the need for applying excessive force is naturally eliminated. Thus, the hand is easily relaxed. Accordingly, progress can be urged by using the bow grip aid of the present invention.

The inventor of the present invention initially developed the bow grip aid for assisting the practice of the cello and the contrabass. However, when the developed device is tested for the violin and the viola, it is understood that the present invention can be also applied to the violin and the viola. It is suitable for the bow grip aid of the violin and the viola. Of course, the size of the device suitable for the violin and the viola is included in the bow grip aid of the present invention.

The inventor of the present invention created several modified examples of the shape of the end portion (referred to as an opening end side) of the first portion 11 and the second portion 13. Here, the end portion is located at the opposite side of the connection portion 12. In several test examples, the shapes where the first portion 11 and the second portion 13 are adjacent to each other at the opening end side so as to be almost in contact with each other were preferable. Namely, when the first portion 11 and the second portion 13 were adjacent to each other at the opening end side so as to almost covering the bow, the beginner could feel the easiness of the practice. Also, it was useful for the player in preventing the bow from being dropped. Also, in the above described cases, the shape is almost same as that of FIG. 12 when viewed from the string side.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

DESCRIPTION OF THE REFERENCE NUMERALS

10: body, 11: first portion, 11*a*, 11*b*: recess, 12: connection portion, 13: second portion, 13*a*: projection, 13*b*, 13*c*: recess, 20: body, 23: second portion, 23*a*: recess, 30: body, 33: second portion, 33*a*: projection.

What is claimed is:

1. A bow grip aid for string instruments, comprising:

a body having a U-shape in cross-section so as to be capable of sandwiching a stick of a bow, wherein the body includes a first portion and a second portion to sandwich the stick with the first portion and the second portion from both sides, a first surface of the first portion has a recess corresponding to a thumb of a player, the first surface being on the opposite side of a second surface contacting with the stick, a distance from a bottom of the recess of the first portion to a surface of the stick is 2 mm to 10 mm, a length of the second portion in a longitudinal direction of the stick is 30 mm to 50 mm, and a thickness of the second portion from a third surface contacting with the stick to a fourth surface is 5 mm to 15 mm, the fourth surface being on the opposite side of the third surface.

2. The bow grip aid according to claim 1, wherein the body is made of an elastic material so as to be capable of expanding an interval between the first portion and the second portion by bending the first portion and the second portion.

3. The bow grip aid according to claim 1, wherein the body includes a connection portion connecting the first portion with the second portion, the connection portion having a cylindrical inner peripheral surface to be capable of being in contact with the stick.

4. The bow grip aid according to claim 1, wherein the recess of the first portion becomes gradually narrow toward a depth direction of the recess.

5. The bow grip aid according to claim 3, wherein an approximately center of the second portion is projected along the longitudinal direction of the stick at a portion near the connection portion when the bow grip aid is attached to the stick.

6. The bow grip aid according to claim 1, wherein the second portion has two recesses along the longitudinal direction of the stick when the bow grip aid is attached to the stick.

7. The bow grip aid according to claim 1, wherein the second portion has a projection at a center of the second portion to divide the second portion into two along the longitudinal direction of the stick when the bow grip aid is attached to the stick.

* * * * *